US007069214B2

(12) United States Patent
Junqua

(10) Patent No.: US 7,069,214 B2
(45) Date of Patent: Jun. 27, 2006

(54) FACTORIZATION FOR GENERATING A LIBRARY OF MOUTH SHAPES

(75) Inventor: Jean-Claude Junqua, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 816 days.

(21) Appl. No.: 10/095,813

(22) Filed: Mar. 12, 2002

(65) Prior Publication Data

US 2002/0152074 A1 Oct. 17, 2002

Related U.S. Application Data

(63) Continuation-in-part of application No. 09/792,928, filed on Feb. 26, 2001.

(51) Int. Cl.
*G10L 13/00* (2006.01)
*G10L 21/06* (2006.01)

(52) U.S. Cl. ..... 704/235; 704/258; 704/276

(58) Field of Classification Search ..... 704/258, 704/260, 270, 235, 276

See application file for complete search history.

(56) References Cited

U.S. PATENT DOCUMENTS

| | | | | |
|---|---|---|---|---|
| 5,608,839 | A * | 3/1997 | Chen | 704/235 |
| 6,112,177 | A | 8/2000 | Cosatto et al. | |
| 6,188,776 | B1 * | 2/2001 | Covell et al. | 382/100 |
| 2003/0072482 | A1 * | 4/2003 | Brand | 382/154 |

OTHER PUBLICATIONS

Bregler et al. "Video Rewrite: Driving Visual Speech with Audio," AVSP, 1997, pp. 153-156.*
Ezzat et al. "MikeTalk: A Talking Facial Display Based on Morphing Visemes," Proc. of the Computer Animation Conference, Philadelphia, Pa., Jun. 1998.*
Shih et al. "Efficient Adaptation of TTS Duration Model to New Speakers," ICSLP, 1998.*
Bregler et al., "Video Rewrite: Driving Visual Speech with Audio" Proc. ACM SIGGRAPH 1997, in Computer Graphics Preceedings, Annual Conference Series, 1997.*
Bregler et al., "Video Rewrite: Visual Speech Synthesis from Video" Proc. of the AVSP '97 Workshop, Rhodes (Greece), Sep. 26-27, 1997.*
* cited by examiner

*Primary Examiner*—V. Paul Harper
(74) *Attorney, Agent, or Firm*—Harness, Dickey & Pierce, PLC

(57) ABSTRACT

A library of mouth shapes is created by separating speaker-dependent and speaker independent variability. Preferably, speaker dependent variability is modeled by a speaker space while the speaker independent variability (i.e. context dependency), is modeled by a set of normalized mouth shapes that need be built only once. Given a small amount of data from a new speaker, it is possible to construct a corresponding mouth shape library by estimating a point in speaker space that maximizes the likelihood of adaptation data and by combining speaker dependent and speaker independent variability. Creation of talking heads is simplified because creation of a library of mouth shapes is enabled with only a few mouth shape instances. To build the speaker space, a context independent mouth shape parametric representation is obtained. Then a supervector containing the set of context-independent mouth shapes is formed for each speaker included in the speaker space. Dimensionality reduction is used to find the areas of the speaker space.

20 Claims, 4 Drawing Sheets

FACTORIZATION FOR GENERATING A LIBRARY OF MOUTH SHAPES

CROSS-REFERENCE TO RELATED APPLICATIONS

This application is a continuation-in-part of U.S. patent application Ser. No. 09/792,928 filed on Feb. 26, 2001. The disclosure of the above application is incorporated herein by reference.

FIELD OF THE INVENTION

The present invention relates generally to generation of a mouth shape library for use with a variety of multimedia applications, including but not limited to audio-visual text-to-speech systems that display synthesized or simulated mouth shapes. More particularly, the invention relates to a system and method for generating a mouth shape library based on a technique that separates speaker dependent variability and speaker independent variability.

BACKGROUND OF THE INVENTION

Generating animated sequences of talking heads in multimedia and text-to-speech applications can be quite tedious, especially for capturing images representing various mouth shapes. As mouth shape is affected by co-articulation phenomenon (influence of one sound on another), achieving a good correspondence between audio and an animated head necessitates a large library of animated shapes. Developments in 3D modeling and the availability of faster computers have sparked a growing interest in the development of realistic talking heads based on images taken from real people and advanced modeling techniques. However, even if creating a computer model of a real head based on a set of pictures is becoming possible, it is still difficult to create a library of mouth shapes that is necessary to perform a good synchronization between the audio data and the visual data or video data.

While strides continue to be made in this regard, previous suggested solutions involve building a co-articulation library using a large number of mouth shapes, and this process is very time consuming. Currently, there is no effective way of building a library of mouth shapes that produces a good synchronization between audio and video short of having a particular speaker spend hours recording examples of his or her mouth shapes.

While it would be highly desirable to be able to build a mouth shape library that produces a good synchronization between audio and video from only a small amount of mouth shape data, that technology has not heretofore existed. Therefore, providing a system and method for building such a library of mouth shapes using only a small amount of mouth shape data remains the task of the present invention.

SUMMARY OF THE INVENTION

In a first aspect, the present invention provides a method for generating a mouth shape library. The method comprises providing speaker-independent mouth shape model information, providing speaker-dependent mouth shape model variability information, obtaining mouth shape data for a speaker, estimating speaker-dependent mouth shape model information based on the mouth shape data and the speaker-dependent mouth shape model variability information, and constructing the mouth shape library based on the speaker-independent mouth shape model information and the speaker-dependent mouth shape model information.

In a second aspect, the present invention is an adaptive audio-visual text-to-speech system comprising a computer memory containing speaker-independent mouth shape model information and speaker-dependent mouth shape model variability information, an input receptive of mouth shape data for a speaker, and a mouth shape library generator operable to estimate speaker-dependent mouth shape model information based on the mouth shape data and the speaker-dependent mouth shape model variability information, and to construct the mouth shape library based on the speaker-independent mouth shape model information and the speaker-dependent mouth shape model information.

In a third aspect, the present invention is a method of manufacturing a mouth shape library generator for use with an adaptive audio-visual text-to-speech system. The method comprises determining speaker-independent mouth shape model information and speaker-dependent mouth shape model variability information based on mouth shape data from a plurality of training speakers, storing the speaker-independent mouth shape model information and the speaker-dependent mouth shape model variability information in computer memory, and providing a computerized method for estimating speaker-dependent mouth shape model information based on speaker-dependent mouth shape data and the speaker-dependent mouth shape model variability information, and constructing the mouth shape library based on the speaker-independent mouth shape model information and the speaker-dependent mouth shape model information.

In a preferred embodiment, the speaker dependent variability is modeled by a speaker space while the speaker independent variability (i.e. context dependency), is modeled by a set of normalized mouth shapes that need be built only once. Given a small amount of data from a new speaker, it is possible to construct a corresponding library of mouth shapes by estimating a point in speaker space that maximizes the likelihood of the adaptation data. This technique greatly simplifies the creation of talking heads because it enables the creation of a library of mouth shapes with only a few mouth shape instances. To build the speaker space, a mouth shape parametric representation is obtained. Then a supervector containing the set of context-independent mouth shapes is formed for each speaker included in the speaker space. Dimensionality reduction techniques, such as Principal Component Analysis (PCA) or Linear Discriminant Analysis (LDA) is used to find the areas of the speaker space.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The presently preferred embodiments generate a library of mouth shapes using a model-based system that is trained by N training speaker(s) and then used to generate mouth shape data by adapting mouth shape data from a new speaker (who may optionally also have been one of the training speakers). The system takes context into account by identifying of mouth shape characteristics that depend on the preceding and following mouth shapes. In a presently preferred embodiment, speaker-independent and speaker-dependent variability are separated or factorized. The system associates context-dependent mouth shapes with speaker-independent variability and context independent mouth shapes with speaker dependent variability.

During training, the speaker independent data are stored in decision trees that organize the data according to context. Also during training, the speaker dependent data are used to construct an eigenspace that represents speaker dependent qualities of the N training speaker population.

Thereafter, when a new mouth shape library is desired, a new speaker supplies a sample of mouth shape data from some, but not necessarily all visemes. Visemes are mouth shapes associated with the articulation of specific phonemes. From this sample of data the new speaker is placed or projected into the eigenspace. From the new speaker's location in eigenspace a set of speaker dependent parameters (context independent) are estimated. From these parameters the system generates a context independent centroid to which the context dependent data from the decision trees is added. The context dependent data may be applied as offsets to the centroid, each offset corresponding to a different context. In this way the entire mouth shape library may be generated. For a more complete understanding of the mouth shape library generation process, refer to FIGS. 1–3 and the following more detailed description.

Figure 1:
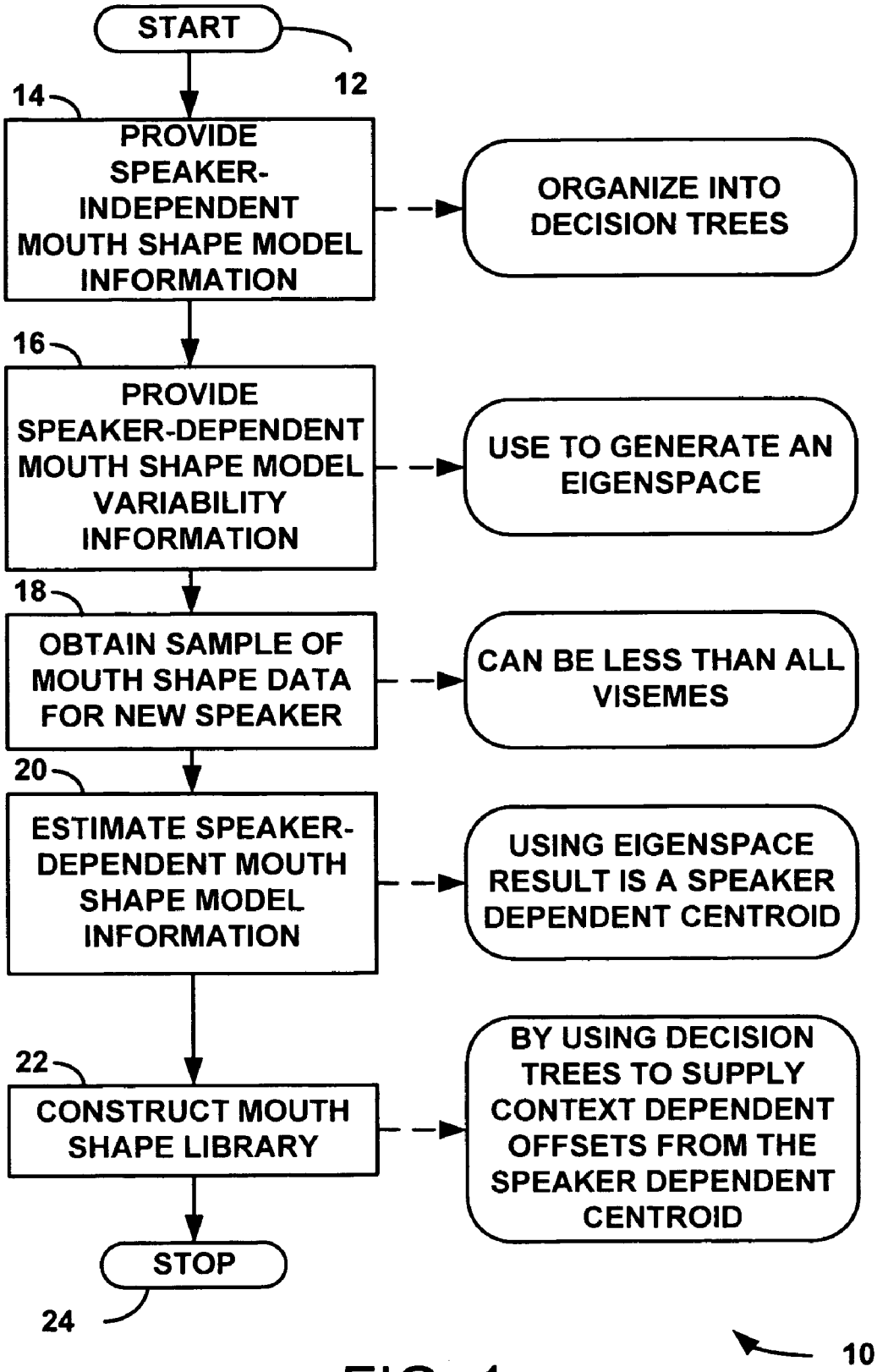
FIG. 1 is a flow chart diagram of a method for generating a mouth shape library according to the present invention.

Referring to FIG. 1, a method 10 for generating a mouth shape library begins at 12 and proceeds to step 14, wherein speaker-independent mouth shape model information is provided. In a preferred embodiment the speaker-independent mouth shape model information corresponds to a parameter space stored in a context-dependent delta decision tree. Proceeding to step 16, method 16 further comprises providing speaker-dependent mouth shape model variability information. In a preferred embodiment, step 16 corresponds to providing a context-independent speaker space operable for use with generating a speaker-dependent, context-independent parameter space based on a speaker-dependent parametric representation of a plurality of mouth shapes. In a presently preferred embodiment, the speaker independent data is used to generate an eigenspace corresponding to N training speakers. Proceeding to step 18, method 10 further comprises obtaining mouth shape data for a new speaker, preferably via image detection following a prompt for mouth shape input. Also preferable, a parametric representation of the mouth shape input is constructed in step 18. In an embodiment that uses an eigenspace to represent the N speaker population, it is not necessary to obtain new speaker input data for all different visemes.

Proceeding to step 20, method 10 estimates speaker-dependent mouth shape model information based on the mouth shape data and the speaker-dependent mouth shape model information. Method 10 further proceeds to step 22, wherein a mouth shape library is constructed based on the speaker-independent mouth shape model information and the speaker-dependent mouth shape model information. In a preferred embodiment, step 22 corresponds to adding the speaker-dependent, context-independent parameter space and the speaker-independent, context-dependent parameter space to obtain a speaker-dependent, context-dependent parameter space. Thus, method 10 ends at 24.

In a preferred embodiment, step 20 corresponds to constructing a speaker-dependent, context-independent supervectors based on the speaker-dependent parametric representation and the speaker-dependent mouth shape model variability information. More specifically, a point is preferably estimated in speaker space (eigenspace) based on the speaker-dependent parametric representation and the speaker-dependent, context-independent supervector is constructed based on the estimated point in speaker space. One method for estimating the appropriate point is to use the Euclidian distance to determine a point in the speaker space, if all visemes are available. If, however, the parametric representation corresponds to Gaussians from Hidden Markov Models, assuming that the mouth shape movement is a succession of states, then a Maximum Likelihood Estimation Technique (MLET) may be employed. In practical effect, the Maximum Likelihood Estimation Technique will select the supervector within speaker space that is most consistent with the speaker's input mouth shape data, regardless of how much mouth shape data is actually available.

The Maximum Likelihood Estimation Technique employs a probability function Q that represents the probability of generating the observed data for a predefined set of mouth shape models. Manipulation of the probability function Q is made easier if the function includes not only a probability term P but also the logarithm of that term, log P. The probability function is then maximized by taking the derivative of the probability function individually with respect to each of the eigenvalues. For example, if the speaker space is on dimension 100 this system calculates 100 derivatives of the probability function Q, setting each to zero and solving for the respective eigenvalue W.

The resulting set of Ws, so obtained, represents the eigenvalues needed to identify the point in speaker space that corresponds to the point of maximum likelihood. Thus the set of Ws comprises a maximum likelihood vector in speaker space. This maximum likelihood vector may then be used to construct a supervector that corresponds to the optimal point in speaker space.

In the context of the maximum likelihood framework of the invention, we wish to maximize the likelihood of an observation O with regard to a given model. This may be done iteratively by maximizing the auxiliary function Q presented below:

$$Q(\lambda, \hat{\lambda}) = \sum_{\theta \in states} P(O, \theta \mid \lambda) \log\left[P(O, \theta \mid \hat{\lambda})\right]$$

where $\lambda$ is the model and $\hat{\lambda}$ is the estimated model.

As a preliminary approximation, we might want to carry out a maximization with regards to the means only. In the context where the probability P is given by a set of mouth shape models, we obtain the following:

$$Q(\lambda, \hat{\lambda}) = const - \frac{1}{2}P(O \mid \lambda)\sum_{\substack{states\\ in\ \lambda}}^{S_\lambda}\sum_{\substack{mixt\\ gauss\\ inS}}^{M_s}\sum_{\substack{time\\ t}}^{T}\{\gamma_m^{(s)}(t)[n\log(2\pi) + \log|C_m^{(s)}| + h(o_t, m, s)]\}$$

where:

$$h(o_t,m,s)=(o_t-\hat{\mu}_m^{(s)})^T C_m^{(s)-1}(o_t-\hat{\mu}_m^{(s)})$$

and let:

$o_t$ be the feature vector at time t $C_m^{(s)-1}$ be the inverse covariance for mixture Gaussian m of state s $\hat{\mu}_m^{(s)}$ be the approximated adapted mean for state s, mixture component m $\gamma_m^{(s)}(t)$ be the P(using mix Gaussian m|λ,$o_t$)

Suppose the Gaussian means for the mouth shape models of the new speaker are located in speaker space. Let this space be spanned by the mean supervectors $\bar{\mu}_j$ with j=1 . . . E, $$\bar{\mu}_j = \begin{bmatrix} \bar{\mu}_1^{(1)}(j) \\ \bar{\mu}_2^{(1)}(j) \\ \vdots \\ \bar{\mu}_m^{(s)}(j) \\ \bar{\mu}_{Ms_\lambda}^{(S_\lambda)}(j) \end{bmatrix}$$

where $\bar{\mu}_m^{(s)}(j)$ represents the mean vector for the mixture Gaussian m in the state s of the eigenvector (eigenmodel) j. Then we need:

$$\hat{\mu} = \sum_{j=1}^{E} w_j \bar{\mu}_j$$

The $\bar{\mu}_j$ are orthogonal and the $w_j$ are the eigenvalues of our speaker model. We assume here that any new speaker can be modeled as a linear combination of our database of observed speakers. Then $$\hat{\mu}_m^{(s)} = \sum_{j=1}^{E} w_j \bar{\mu}_m^{(s)}(j)$$

with s in states of λ, m in mixture Gaussians of M.

Since we need to maximize Q, we just need to set $$\frac{\partial Q}{\partial w_e} = 0,\ e = 1 \ldots E.$$

(Note that because the eigenvectors are orthogonal, $$\frac{\partial w_i}{\partial w_j} = 0,\ i \neq j \ldots )$$

Hence we have $$\frac{\partial Q}{\partial w_e} = 0 = \sum_{\substack{states\\ in\ \lambda}}^{S_\lambda}\sum_{\substack{mixt\\ gauss\\ inS}}^{M_s}\sum_{\substack{time\\ t}}^{T}\left\{\frac{\partial}{\partial w_e}\gamma_m^{(s)}(t)h(o_t, s)\right\},\ e = 1 \ldots E.$$

Computing the above derivative, we have:

$$0 = \sum_s\sum_m\sum_t \gamma_m^{(s)}(t)\left\{-\bar{\mu}_m^{(s)T}(e)C_m^{(s)-1}o_t + \sum_{j=1}^{E} w_j\bar{\mu}_m^{(s)T}(j)C_m^{(s)-1}\bar{\mu}_m^{(s)}(e)\right\}$$

from which we find the set of linear equations $$\sum_s\sum_m\sum_t \gamma_m^{(s)}(t)\bar{\mu}_m^{(s)T}(e)C_m^{(s)-1}o_t = \sum_s\sum_m\sum_t \gamma_m^{(s)}(t)\sum_{j=1}^{E} w_j\bar{\mu}_m^{s(T)}(j)C_m^{(s)-1}\bar{\mu}_m^{(s)}(e),\ e = 1 \ldots E.$$

Figure 2:
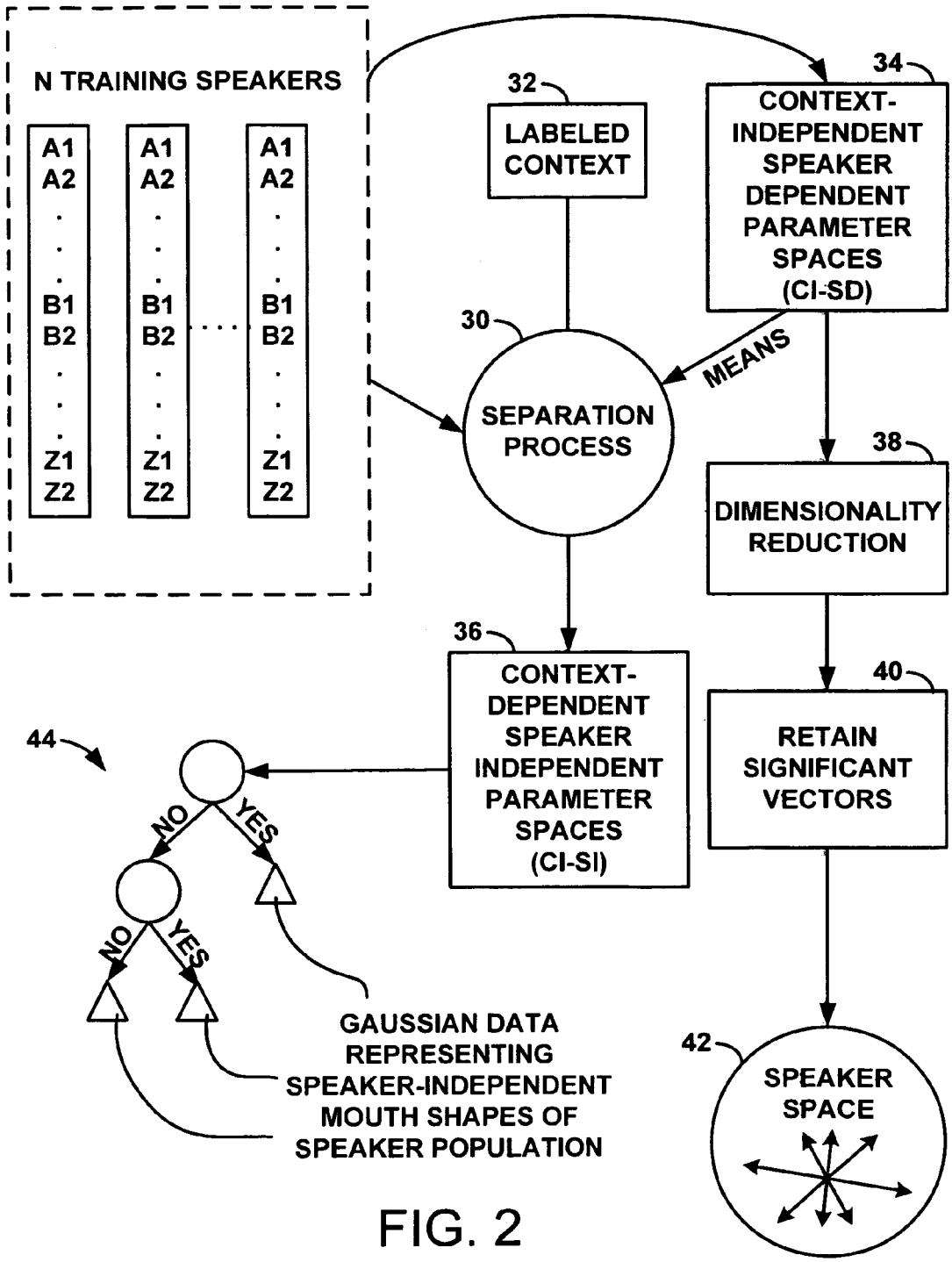
FIG. 2 is a block diagram of factorization of speaker dependent and speaker independent variability according to a preferred embodiment of the present invention.

Referring to FIG. 2, a preferred embodiment of speaker-dependent and speaker-independent factorization has parameter spaces constructed based on mouth shape input from N training speakers as shown at 26. The training speaker parameter space comprises supervectors 28 that are generated from the mouth shape data taken from the training speakers. For example, the mouth shapes may be modeled as HMMs or other probabilistic models having one or more Gaussians per state. The parameter space may be constructed by using the parametric values used to define those Gaussians.

The context-dependent (speaker-independent) and context-independent (speaker-dependent) variability are separated or factorized by first obtaining context-independent, speaker-dependent data 34 from the training speaker data 26. The means of this data 34 are then supplied as an input to the separation process 30. The separation process 30 has knowledge of context, from the labeled context information 32 and also receives input from the training speaker data 26. Using its knowledge of context, the separation process subtracts the means developed from the context-independent, speaker-dependent data, from the training speaker data. In this way, the separation process generates or extracts the context-dependent, speaker-independent data 36. This context-dependent, speaker independent data 36 is stored in the delta decision tree data structure 44.

In a presently preferred embodiment, Gaussian data representing the context-dependent speaker-independent data 36 are stored in the form of delta decision trees 44 for various visemes that consist of yes/no context based questions in the non-leaf nodes 46 and Gaussian data representing specific mouth shapes in the leaf nodes 48.

Meanwhile, the context-independent speaker-dependent data 34 is reflected as supervectors that undergo dimensionality reduction at 38 via a suitable dimensionality reduction technique such as Principal Component Analysis (PCA), Independent Component Analysis (ICA), Linear Discriminant Analysis (LDA), Factor Analysis (FA), or Singular Value Decomposition (SVD). The results of are extracted sets of eigenvectors and associated eigenvalues. In one preferred embodiment, some of the least significant eigenvectors may be discarded to reduce the size of the speaker space 42. Thus, the process optionally retains a number of significant eigenvectors as at 40 to comprise the eigenspace or speaker space 42. It is also possible, however, to retain all of the generated eigenvectors, but 40 is preferably included to reduce memory requirements for storing the speaker space 42.

Once the eigenspace (speaker space 42) and delta decision trees 44 have been generated for the N training speakers, the system is now ready for use in generating a library of mouth shapes for a new speaker. In this context, the new speaker can be a speaker that has not previously provided mouth shape data during training, or it can be one of the speakers who participated in training. The system and process for generating a new library is illustrated in FIG. 3.

Figure 3:
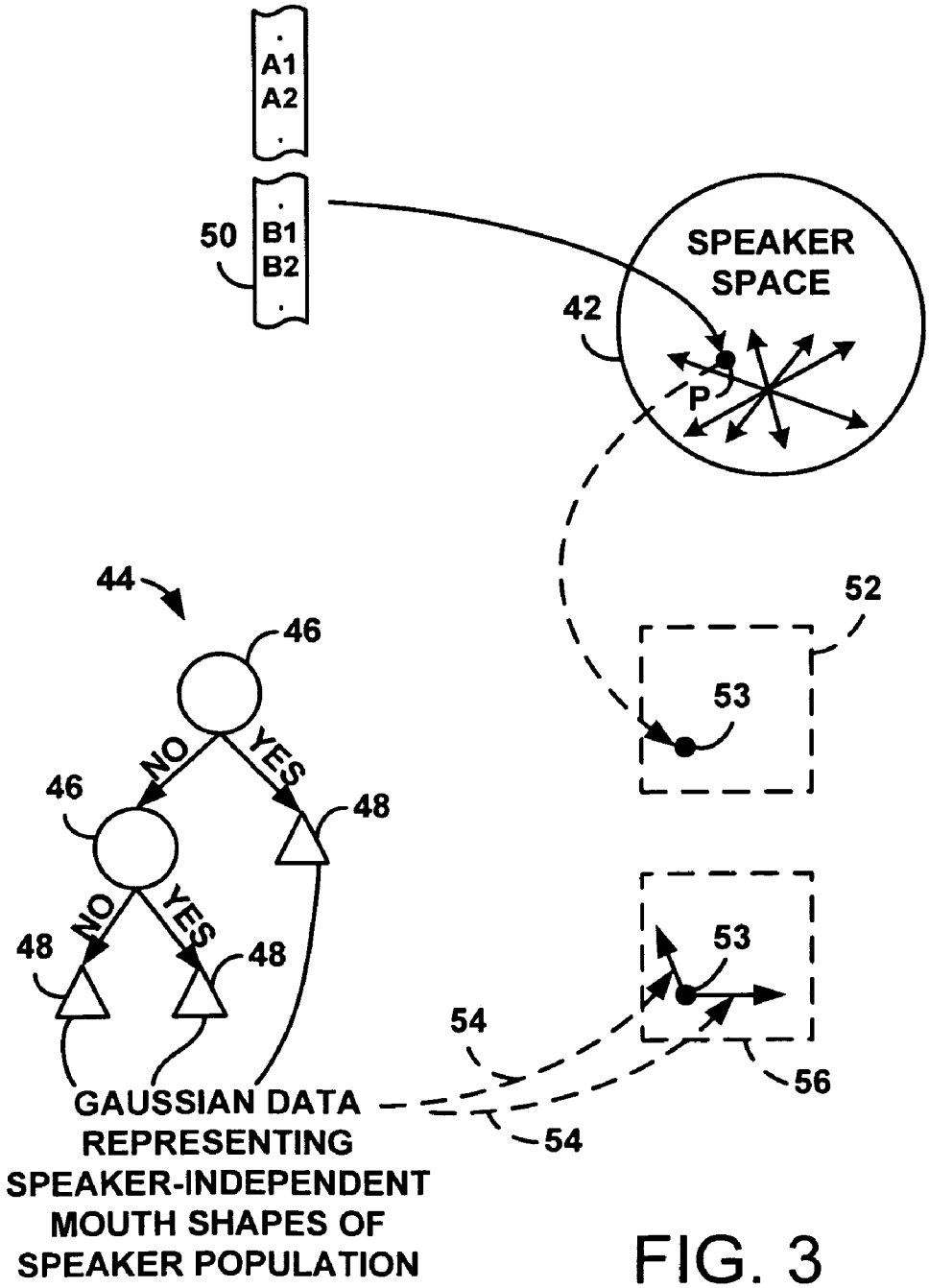
FIG. 3 is a block diagram of mouth shape library generation according to a preferred embodiment of the present invention.

Referring to FIG. 3, a parametric representation of mouth shape data 50 from a new speaker is first obtained. While a full set of parameter data of mouth shapes for all visemes could be collected at this stage, in practice this is not necessary. It is simply sufficient to get enough examples of mouth shape data to allow a point in the eigenspace to be identified. Thus, a point P in speaker space 42 is estimated based on the parametric representation of mouth shape data 50, and a context-independent, speaker-dependent parameter space 52 is generated in the form of a centroid 53 corresponding to the point P in the eigenspace (speaker space). One significant advantage of using the eigenspace is that it will automatically estimate parameters for mouth shape visemes that have not been supplied by the new speaker. This is because the eigenspace is based on the speaker-dependent data of the N training speaker population, for which a full set of mouth shape data has preferably been provided.

Context-dependent, speaker-independent mouth shape data 48 stored in the form of the delta decision trees 44 are added at 54 to the context-independent, speaker-dependent centroid 53 to arrive at the mouth shape library.

More specifically, the context-dependent, speaker independent data is then retrieved from the delta decision trees, for each context, and this data is then combined or summed with the speaker-dependent data generated using the eigenspace to produce a library of mouth shapes for the new speaker. In effect, the speaker-dependent data generated from the eigenspace can be considered a centroid, and the speaker-independent data can be considered as "deltas" or offsets from that centroid. In this regard, the data generated from the eigenspace represents mouth shape information that corresponds to a particular speaker (some of this information represents an estimate by virtue of the way the eigenspace works). The data obtained from the delta decision trees represents speaker-independent differences between mouth shapes in different contexts. Thus a new library of mouth shapes is generated by combining the speaker-dependent (centroid) and speaker-independent (offset) information for each context.

Figure 4:
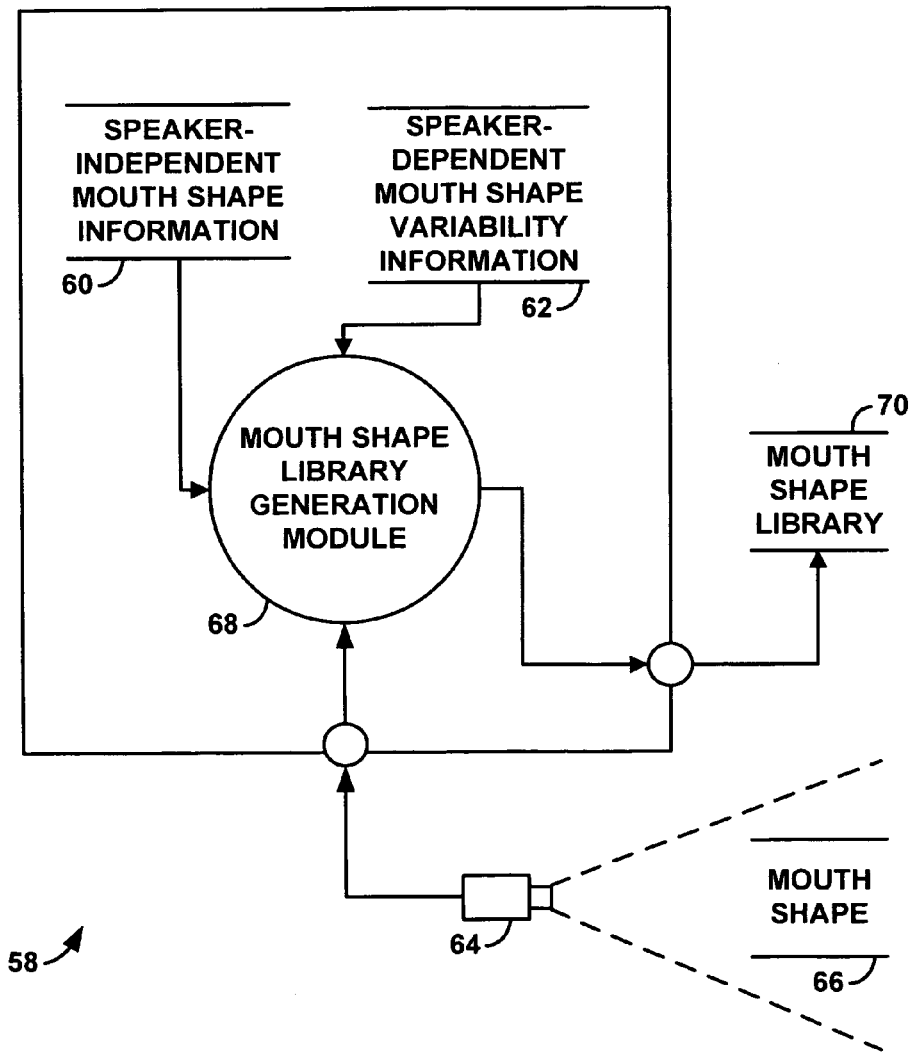
FIG. 4 block diagram of an adaptive audio-visual text-to-speech system according to the present invention.

Referring to FIG. 4, an adaptive audiovisual text-to-speech system 58 of the present invention has speaker-independent mouth shape model information 60 and speaker-dependent mouth shape model variability stored in computer memory. It further features an input 64 receptive of mouth shape data 66 from a new speaker. Mouth shape library generator 68 is operable to estimate speaker-dependent mouth shape model information (not shown) based on the mouth shape data 66 and the speaker-dependent mouth shape model variability information 62, and to construct the mouth shape library 70 based on the speaker-independent mouth shape model information 60 and the speaker-dependent mouth shape model information (not shown).

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for generating a mouth shape library, comprising the steps of:

providing speaker-dependent mouth shape model information based on a composite of training speakers, wherein said speaker-dependent mouth shape model information is contained in an eigenspace;

obtaining mouth shape data for a new speaker;

estimating speaker-dependent mouth shape model information of said new speaker based on a projection of said mouth shape data for said new speaker in said eignspace;

extracting speaker-independent mouth shape model information from data generated from said composite of training speakers by separating said speaker-dependent mouth shape model information of said new speaker from said data generated from said composite of training speakers; and constructing the mouth shape library by combining said speaker-dependent mouth shape model information of said new speaker with said speaker-independent mouth shape model information organized by context, wherein said context depends on preceding and following mouth shapes of a desired mouth shape.

2. The method of claim 1 wherein said speaker-independent mouth shape model information is organized into a decision tree.

3. The method of claim 1 further comprising organizing said speaker-independent mouth shape model information into a decision tree having nodes organized according to context.

4. The method of claim 1 wherein said speaker-dependent mouth shape model information is represented in a reduced dimensionality speaker space.

5. The method of claim 1 wherein said speaker-dependent mouth shape model information of said new speaker is represented by a centroid and the speaker independent mouth shape model information is represented by an offset applied to said centroid, wherein said offset corresponds to a distinct said context.

6. The method of claim 1 wherein said mouth shape data for said new speaker corresponds to visemes.

7. The method of claim 1 wherein said step of obtaining mouth shape data for a new speaker is performed by collecting a sample of viseme data from said new speaker.

8. The method of claim 7 wherein said sample of viseme data represents less than the entire set of visemes of the spoken language.

9. The method of claim 1 further comprising:

obtaining mouth shape input from at least one training speaker;

observing a plurality of mouth shapes from said training speaker;

constructing a speaker-dependent parametric representation of said observed plurality of mouth shapes; and using said parametric representation to generate said speaker-dependent mouth shape model information of said new speaker.

10. The method of claim 1 wherein said speaker-dependent mouth shape model information is based on dependent mouth shapes that are dependent upon characteristics of each said training speaker and said speaker-independent mouth shape model information is based on independent mouth shapes that are independent of said characteristics of each said training speaker.

11. The method of claim 1 wherein said eigenspace automatically supplies other mouth shape data distinct from said mouth shape data of said new speaker based on said composite of said training speakers.

12. A mouth shape library generating system, comprising:

a computer memory containing speaker-independent mouth shape model information based on a composite of training speakers and speaker-dependent mouth shape model information, wherein said speaker-dependent mouth shape model information is contained in an eigenspace;

an input receptive of mouth shape data for a new speaker;

a centroid generator operable to estimate a speaker-dependent centroid of said new speaker based on a projection of said mouth shape data of said new speaker in said eigenspace;

a library constructor that combines said speaker-dependent centroid with said speaker-independent mouth shape model information organized by context to thereby construct a mouth shape library, wherein said context depends on preceding and following mouth shapes of a desired mouth shape and said speaker-independent mouth shape model information is represented by an offset.

13. The system of claim 12 wherein said speaker-independent mouth shape model information is organized into a decision tree stored in said memory.

14. The system of claim 12 wherein said speaker-independent mouth shape model information is stored in said memory as at least one decision tree having nodes organized according to context.

15. The system of claim 12 wherein said speaker-dependent mouth shape model information is represented in a reduced dimensionality speaker space.

16. The system of claim 12 wherein said speaker-dependent mouth shape model information is based on dependent mouth shapes that are dependent upon characteristics of each said training speaker and said speaker-independent mouth shape model information is based on independent mouth shapes that are independent of said characteristics of each said training speaker.

17. The system of claim 12 wherein said eigenspace automatically supplies other mouth shape data distinct from said mouth shape data of said new speaker based on said composite of said training speakers.

18. The system of claim 17 wherein said sample of viseme data represents less than the entire set of visemes of the spoken language.

19. The system of claim 12 wherein said mouth shape data for said new speaker corresponds to visemes.

20. The system of claim 12 wherein said input collects a sample of viseme data from said new speaker.

* * * * *